US005235929A

United States Patent [19]

Chester et al.

[11] Patent Number: 5,235,929

[45] Date of Patent: Aug. 17, 1993

[54] DOCKING SYSTEM

[75] Inventors: Barbara A. Chester, West Borough, Mass.; Ronald F. McConnell, West Chester, Pa.

[73] Assignee: Leisure Docks Inc., West Chester, Pa.

[21] Appl. No.: 921,918

[22] Filed: Jul. 29, 1992

[51] Int. Cl.[5] ..... B63B 35/44

[52] U.S. Cl. ..... 114/266; 114/267

[58] Field of Search ..... 114/263, 264, 265, 266, 114/267, 258

[56] References Cited

U.S. PATENT DOCUMENTS

| | | | |
|---|---|---|---|
| 3,191,565 | 6/1965 | Filak . | |
| 3,323,479 | 6/1967 | Filak . | |
| 3,595,192 | 7/1971 | Vega | 114/267 |
| 3,673,975 | 7/1972 | Strauss . | |
| 3,824,644 | 7/1974 | Stranzinger . | |
| 3,878,803 | 4/1975 | Leverton | 114/267 |
| 4,067,285 | 1/1978 | Jones et al. | 114/267 |
| 4,604,962 | 8/1986 | Guibault . | |
| 4,962,716 | 10/1990 | Fransen et al. . | |
| 4,988,317 | 1/1991 | Robinsak et al. . | |
| 5,117,775 | 6/1992 | Northam et al. . | |

OTHER PUBLICATIONS

Brochure, Seacoast Enterprises Associates, Inc. "HM92683 Oct. 1983" (2 pages).

Brochure, Continental Dock Systems "Continental Fiberglass Docks & Floats" (5 pages).

Brochure, Sullivan Flotation Systems "'A' Type Docks" (2 pages).

Brochure, Great Lakes Docks & Decks "Rowing Dock" (1 page).

Brochure, Follansbee Dock Systems "1991" (41 pages).

Brochure, Meeco Marinas Incorporated "The Captain" (4 pages).

*Primary Examiner*—Jesus D. Sotelo

*Assistant Examiner*—Stephen P. Avila

*Attorney, Agent, or Firm*—Edward J. Kaliski

[57] ABSTRACT

A docking system is disclosed in which modules that are of integral, unitary structure may be joined to form a floating dock. Each module is made up of a deck and side walls to form a hollow chamber within which is disposed a flotation unit of a large-scale honeycomb made by joining plastic containers to each other and to the deck and side walls. A substantially isotropic tension member or system of tension members is joined to the bottom of the walls and cells to complete a module in which applied forces are shared by all elements. Apparatus for aligning and joining modules to form dock structures are described as are apparatus to ballast the structure and determine freeboard.

24 Claims, 5 Drawing Sheets

DOCKING SYSTEM

FIELD OF THE INVENTION

This invention relates to a docking system and more particularly to a system of portable, floating, modular elements.

BACKGROUND OF THE INVENTION

Various types of floating docks are available that are assembled from modular elements to enable ease of assembly and portable use. Portable docking systems are used in northern climes where they ordinarily are removed from the water and stored during the winter.

Rubinsak et al. in U.S. Pat. No. 4,988,317 discloses a sectionalized float which can be disassembled and stacked for storage. A deck is braced by a grid; a large-scale egg-crate of two-by-four lumber for example. Within the grid are fastened the lids of large, screw-top containers such as five gallon plastic buckets. These are removably screwed onto the lids to form individual, sealed floats to comprise a pontoon. A means to join pontoons is provided to form complex floating structures.

In U.S. Pat. No. 3,191,565, Filak teaches the use of post-tensioned cables to hold together a complex of float units.

In U.S. Pat. No. 3,323,479, Filak teaches using ballast tanks for stability in a flotation module.

In U.S. Pat. No. 3,673,975, Strauss teaches a floating platform that includes a plurality of air cells to support a platform. The cells comprise a heavy gauge polyethylene sheeting pursed and inverted so that air can not escape. The bottom thus is open to the water. Means for subsequent addition of air is also described as is a skirting around the edge of the platform.

Northam et al., in U.S. Pat. No. 5,117,775, teaches a flotation device in which the hollow interior of a molded shell is filled with recycled, sealed plastic bottles. These are layered and oriented and aligned end to end or are disposed with the neck of one lying adjacent the neck of its neighbor. The shell has indentations to accommodate the necks and may be filled with a foam material. The bottles may be detachably bonded for ease of orderly loading or may be randomly placed. The shell may be sealed or have an opening to permit ballast water to enter. The bottles are not disposed to be structural, load-bearing elements and the shell/bottle combination is not disposed to be a dock structure in itself.

Floating docks of the prior art are float and beam devices. In essence the deck is a beam structure which is supported by one or more separate flotation means. A concentrated load on the deck must be carried by the deck beams to the floats. The beam structure must be of sufficient size and stiffness and therefore weighs an excessive amount given the use of standard materials.

The prior art beam and float units do not use the materials of construction in an efficient way. If the floats were closer together, however, the deck could be of lighter construction. Also, if the floats were both close and fused together (i.e. unitary) they could act also as stiffeners to the deck and the deck could be of the lightest construction.

In U.S. Pat. No. 3,824,644, Stranzinger teaches the use of prismatic flotation bodies that have protruding lugs which can be mated using connecting bolts to produce a connected flotation structure.

In U.S. Pat. No. 4,604,962, Gibault teaches the use of similar prismatic flotation bodies joined together to form a dock.

Both Stranzinger's and Gibault's teachings attach the floats together so that they can pivot at their joints. Flexure stresses are not carried from float to float since they are not attached as an integral, unitary structure. Additionally, there is no continuous upper deck structure to act as the upper (beam) flange nor is there a lower continuous sheet, or its equivalent, to act as the bottom flange. Again, these jointed structures do not use the materials of construction in an efficient manner Commercial modules are available fabricated from wood and drum floats, and a variety of high density polyethylene pontoons or slabs used as flotation elements in combination with wooden or metal structural materials. Many of these form beam structures. These units are effective but suffer from limitations. Either the modules are too heavy for easy portability or, to achieve a readily handled module, they are too small which makes the platforms unstable when people stand on them and when the waves set the assembled modules in motion. Other problems include cost and also corrosion where wood and metal are employed.

It is an object therefore of the instant invention to overcome the shortcomings of the prior art and to provide flotation modules that are of integral, unitary structure and so are lightweight, low cost, and truly portable in being easy to get on and off the water.

BRIEF DESCRIPTION OF THE INVENTION

The above objects and others are achieved in the docking system of the invention which comprises conjoined modules of integral, unitary structure. "Integral, unitary structure" means a structure which transmits a load applied to a member to all the other members which share the resultant stresses with all members functioning as a unit. Each module comprises a substantially planar deck joined along the periphery to a downwardly depending wall or walls and an open bottom to create a hollow chamber with a flotation means disposed therein abutting the deck and joined or bonded thereto wherein the flotation means comprises a large-scale honeycomb of adjacent cells. The cells may be open, limitedly-open, or closed on the downward side and may be ballasted. They are joined or bonded to each other and to the wall or walls at points of contact. Tensile means, in the form of straps, perforated sheets, or isotropic nets, are attached at the bottom of the honeycomb core structure and joined or bonded to the wall or walls and the cells at points of contact. The honeycomb core structure, therefore, provides flotation and also carries vertical and horizontal shear stresses in the overall structure while the top and bottom surfaces carry the horizontal compressive and tensile stresses. The deck also must carry local vertical "live" loads were not directly supported by the honeycomb cells underneath, In a preferred embodiment, the large-scale cells of the honeycomb are fabricated from plastic bottles or the like in a close, compact array with the closures extending downwardly. These may be used containers which have been recycled thus providing still one more advantage to the invention.

Because the structure is an integral, unitary structure, the materials of construction are used efficiently. Light weight plastic components may be employed making a reasonably-sized, truly-portable module. As a result, modules of the invention are particularly useful for docking racing shells either at the club house or at temporary regatta launch sites. Similarly, private waterfront use as boat or fishing docks or as swimming floats is contemplated. Indeed, commercial establishments, where heavy-duty permanent structures are the norm, can find use for these modules as additional, temporary dockage.

DETAILED DESCRIPTION OF THE INVENTION

Figure 1:
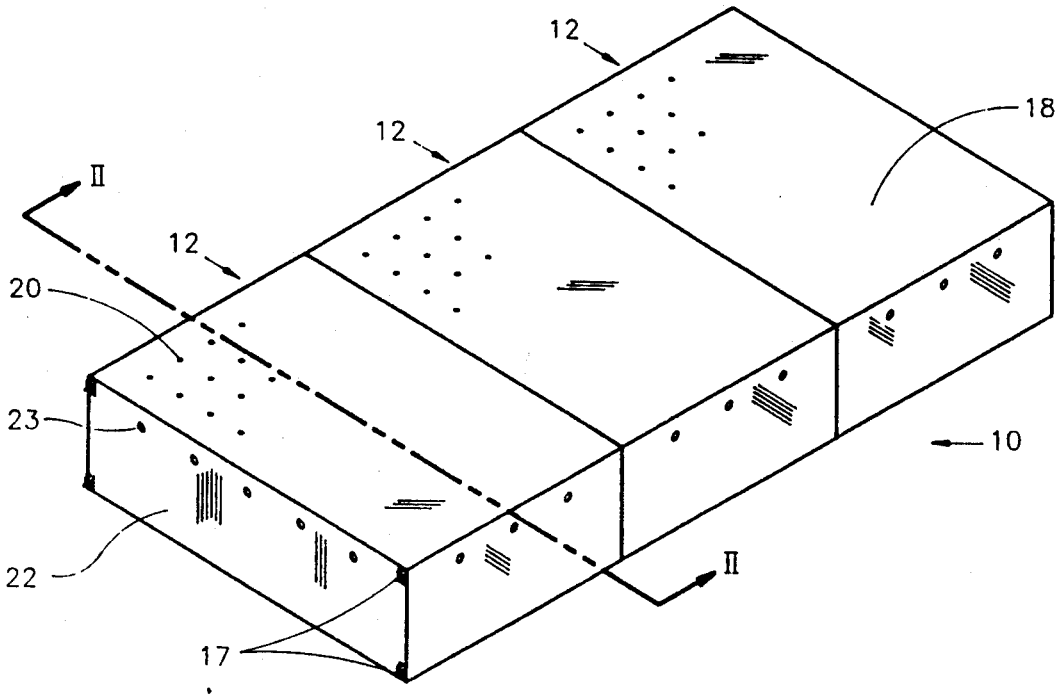
FIG. 1 is a perspective view of modules illustrating several such joined, one to the other.
Figure 3:
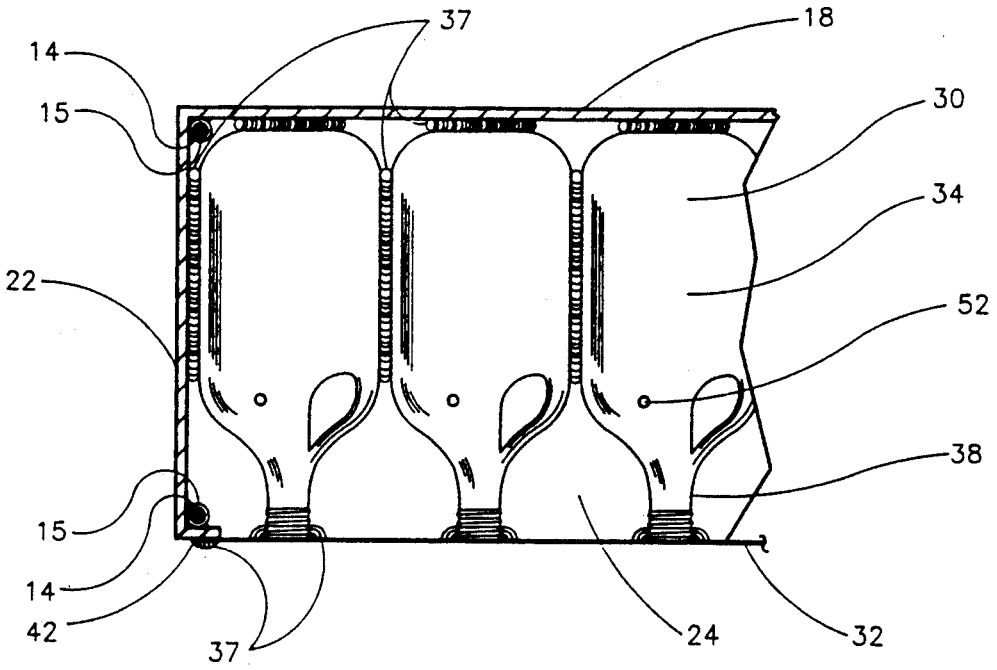
FIG. 3 is an elevational cross-section of a module similar to FIG. 2 in which all cells are open.
Figure 4:
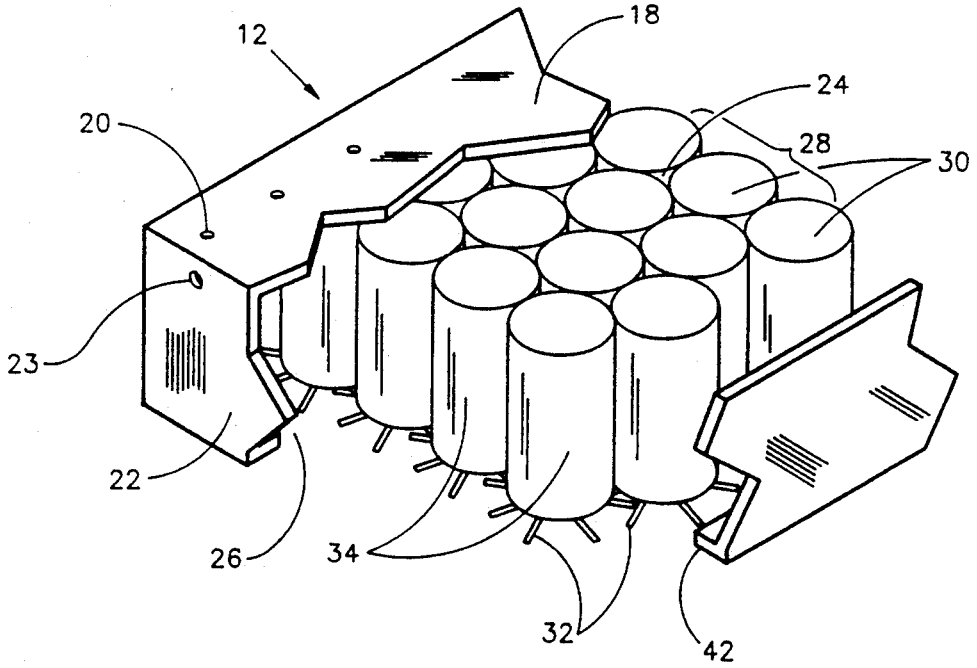
FIG. 4 is a truncated perspective view in partial cross-section of a portion of a module of the invention.

The docking system of the invention is designated by 10 and is best seen in FIG. 1 and FIG. 4. Docking system 10 comprises one or more modules 12 and, where there is a plurality of modules, abutted and held together by tie members 14 which may be rods or, preferably, cables with suitable end fittings and which extend through tubular encasements 15 (see FIGS. 6 and 7) located in continuous open space, such as in the upper and lower corners (FIGS. 2 and 3), from one end to the other end of the entire dock structure. The tie members 14 are elastic and provide restoring force when the adjacent modules 12 are separated. The local displacement of the adjacent modules is elastically spread over the total tie member length. The rod or cable tie member 14 is lubricated and free to stretch uniformly inside tube 15. Each end 17 of tie member 14 is fastened to the structure by fitting 16 which can be swaged in place. This can be a threaded device as is known with a nut 19 and a washer 21 (FIG. 7) to provide a pretensioned assembly.

Figure 6:
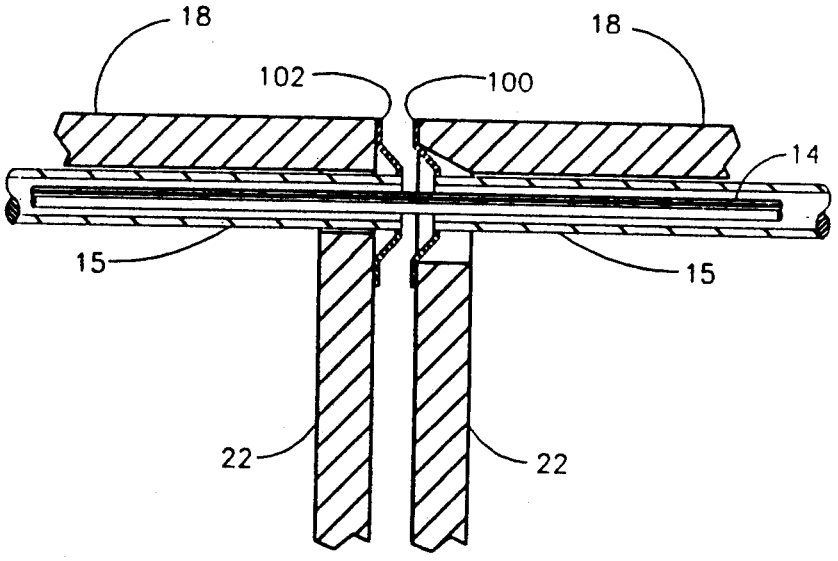
FIG. 6 is a partial, cross-section of a typical fitting aligning modules of the invention where they abut shown before the modules are pulled together.
Figure 7:
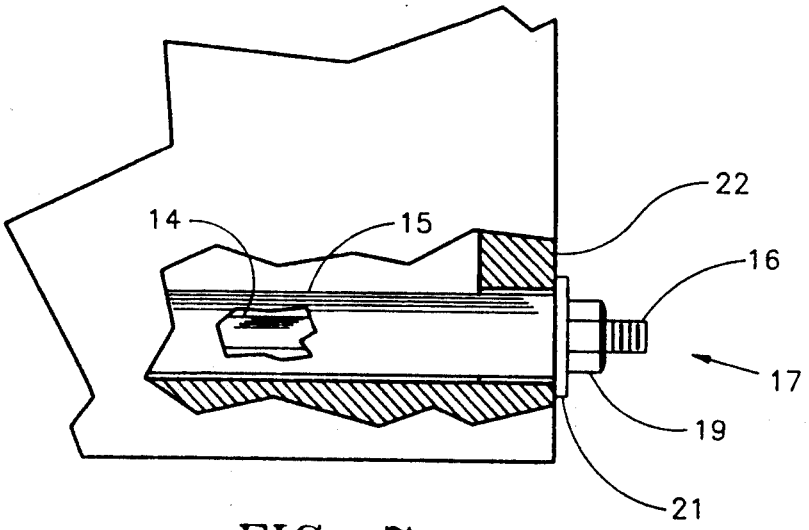
FIG. 7 is a partial, cross-section of a typical end fitting for the tie members used to hold modules together

Between modules 12, ordinarily, concave alignment units 100 are used on one side of a module and convex units 102 on the other as seen in FIG. 6 and these nest to limit relative vertical displacement. Units 100 and 102 can be interchangeable simply by turning them over as desired before fastening them onto wall 22 over a hole placed therein. Such units are best made of wear resistant, low friction material such as nylon or DELRIN TM (available from E. I. DuPont de Nemours and Company, Wilmington, DE 19898)

A module 12, as shown in FIG. 4, comprises a deck 18, which optionally is a perforate sheet as suggested somewhat schematically at 20. Joined to deck 18 is a wall (or walls) 22, also preferably perforate as indicated by 23, thus forming a hollow chamber 24 with an open bottom 26. Flange 42 optionally is used to stiffen wall(s) 22 and to facilitate attachment of the tension member straps 32 or perforate sheet 46 (see FIGS. 2, 3 and 9). The perforations 20 and 23 release or supply air as the water level 53 (FIG. 8) rises and falls within chamber 24. We prefer to fabricate deck 18 and wall(s) 22 from polymeric materials such as polyethylene, usually one-eighth inch thick. We may use in either or both components material that is reinforced with continuous polymeric or glass fibers.

Figure 2:
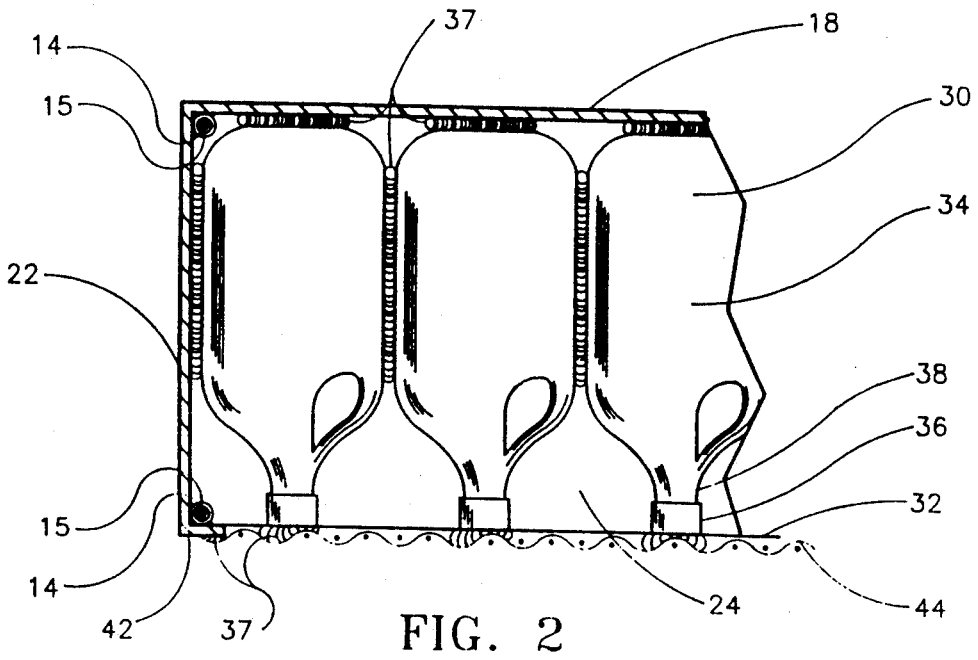
FIG. 2 is a partial, elevational cross-section of a module of the invention taken on the line II—II of FIG. 1 in which all cells are closed.

Disposed in chamber 24 is a flotation means 28 which abuts deck 18 on the underside and all of the wall(s) 22 and, as seen in FIGS. 2 and 3, is joined or bonded at the points of contact by adhesive 37. Such an adhesive must provide a rapid cure tack for ease of fabrication and, in service, must be water resistant, not deform the plastic to which it is bonded, and have considerable flexibility as well as a long life in use.

Figure 9:
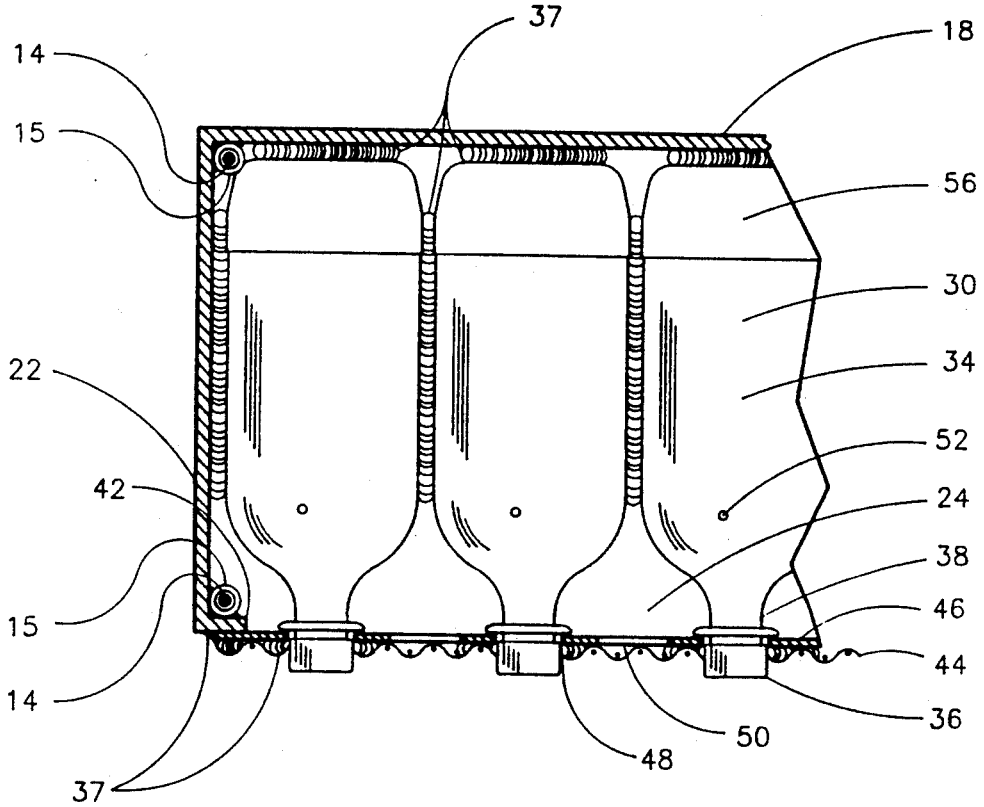
FIG. 9 is a truncated cross-section in elevation similar to FIG. 2 but showing an embodiment using an isotropic perforated sheet or net as the tension means and cell openings shown in FIG. 8.

This flotation means 28 is a large scale honeycomb of cells 30 adjacently abutting and adhesively joined one to the other at points of contact by adhesive 37. The term "large scale" is used to differentiate the honeycomb of the invention from the honeycomb structures often employed in aerospace applications in which the cells range from 10 mm to about 25 mm across the cells themselves and are at most about 25 mm deep. In the instant invention, the cells are best made up of thin walled plastic containers exemplified by one pint, one, two, or three liter soda containers or one gallon milk containers. Many other such plastic containers are found in commerce that are suitable in particular service such as five gallon paint containers. These include containers for still and carbonated beverages including those that are hot-filled (such as for cranberry juice), water, bleach and the like. The presence of a handle ordinarily does not interfere with service as a cell. It should be noted that most carbonated beverage containers are made with an attached base 56 as seen in FIG. 9 that provide the relatively flat surface on which the container stands. We prefer to leave this base 56 attached and add a water resistant adhesive to the existing adhesive to ensure long marine service. The closed ends of the containers are placed as the upper ends and are bonded to the under side of the deck 18 (FIG. 9). The lower ends, as will be seen, are open or closed.

Figure 5:
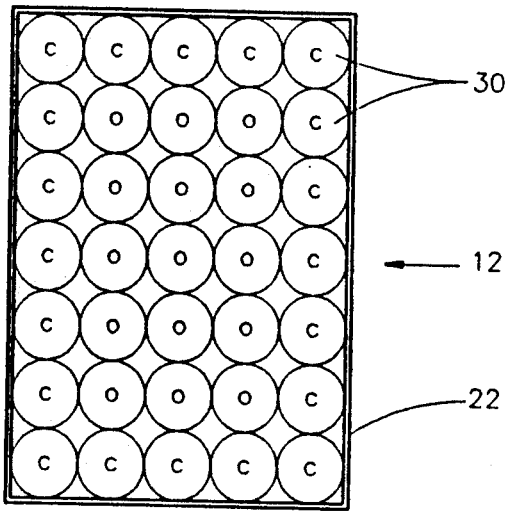
FIG. 5 is a cross sectional plan view of a module showing both open and closed cells used in combination.

A closely packed array of cells 30 is used (FIGS. 4 and 5). The individual components may be located on an orthogonal grid or staggered. The former provides more lines of contact with the walls. It also should be noted that while we prefer to use wall(s) 22 and to bond the outermost cells of the close-packed array to them, the structure is operative in their absence as the outer periphery of cells can in fact act as the wall(s) 22. Further to be noted is that the flotation means described has wide application to marine service. For example, the hull of a small vessel could use an array such as described above under the deck as flotation to prevent sinking.

Referring now to FIG. 2, there are seen three adjacent cells 30 which are plastic containers 34 such as ordinarily hold bottled water or soda or milk and contain a gallon more or less. These, of course, can be new or can be recycled after fulfilling their original intended use. These containers are joined one to the other, and to the deck 18, to the side walls 22, and to the strap members 32 by adhesive means 37 Each container 34 is sealingly capped with a screw cap 36. We prefer to fix a cap 36 to the neck of a container 34 by placing a suitable adhesive 37 on the threads before screwing on the cap.

As shown in FIGS. 2, 3 and 4, tension members such as straps 32 are disposed at the bottom of the core structure and are attached, preferably by adhesive 37, to wall(s) 22, and the bottom of any cell 30 which is passed. Straps 32 are best oriented quasi-isotropically as shown in FIG. 4. Straps 32 may be made from polymeric material and are best reinforced by continuous filaments of glass or polymer. These straps 32 function normally as tension members when the module 12 is in the water and loads are applied to deck 18. While the strap form is preferred, straps 32 may be replaced by filaments or rods. A screen 44 may optionally be attached to the bottom of side wall(s) 22, or to optional flange 42 to keep out the usual flotsam and jetsom, various forms of marine life as well as provide some tension function.

The tension function may also be supplied by a perforated sheet 46 (FIG. 9) similar to the deck 18 but not necessarily as thick. If a bottom sheet 46 as shown in FIG. 9 is used, it must be adaquately perforated by holes 50 to permit flow of water freely in and out of chamber 24 and thus constitutes a net. This water acts as ballast to offer stability to the dock module 12. Such a sheet 46 should have essentially isotopic properties. It can be fabricated from plastic barrier material or a plastic netting such as VEXAR made by Conwed Plastics of St. Paul, MN. We prefer to use a sheet 46 made from 1/16 thick polyethylene with holes 48 on the same centers as the cell bottle necks 38 so that the holes 48 can be snapped over necks 38 against shoulder 39 and secured by caps 36 and adhesive 37, Ordinarily straps 32 or sheet 46 carry tension, but when a single wave rolls under the module 12 or the module 12 is floated upside down or during transport, these members are subjected to some compression. Because the spans are short and because of the thickness and properties of the materials of construction, this compression is tolerated. Moreover, the cells 30 of the honeycomb, being bonded together and in close compacted array, also can support a level of compression along a lower plane. If bottom sheet 46 is used, screen 44 may be eliminated but we prefer to use screen 44 in addition as shown in FIG. 9 to keep openings 50 from being clogged by debris.

In use, concentrated vertical loads on deck 18 of a module 12, such as are caused by people walking, are uniformly supported over the total area when the dock is in the water by the flotation means 28. The flotation 28 consists of a multiplicity of cells 30 and top and bottom stress bearing members: deck 18 and straps 32 or perforate sheet 46. The close compact array of cells 32 within the modular structure and bonding on all vertical sides, tops and bottoms, form an integral core structure which carries vertical and horizontal flexure shear stresses. Compressive flexure loads are carried by the deck 18 which is bonded to the cells 30. Tensile flexure stresses within this structure, which may be likened to a beam, are carried by the straps 32 or sheet 46 which are also attached at the neck end.

In the configuration of FIG. 3, the bottle necks 38 are exposed (not capped) providing limited opening to the volume inside. Ballast water 54 (FIG. 8) enters and leaves provided the there is venting by a second hole 52. The size of the openings will control the rate at which water enters and leaves. The maximum rate would occur if the containers were made with full diameter openings at the lower end as initially formed and shown in FIG. 3 or by cutting off part of the bottle above the neck 38 to expose a larger diameter.

Figure 8:
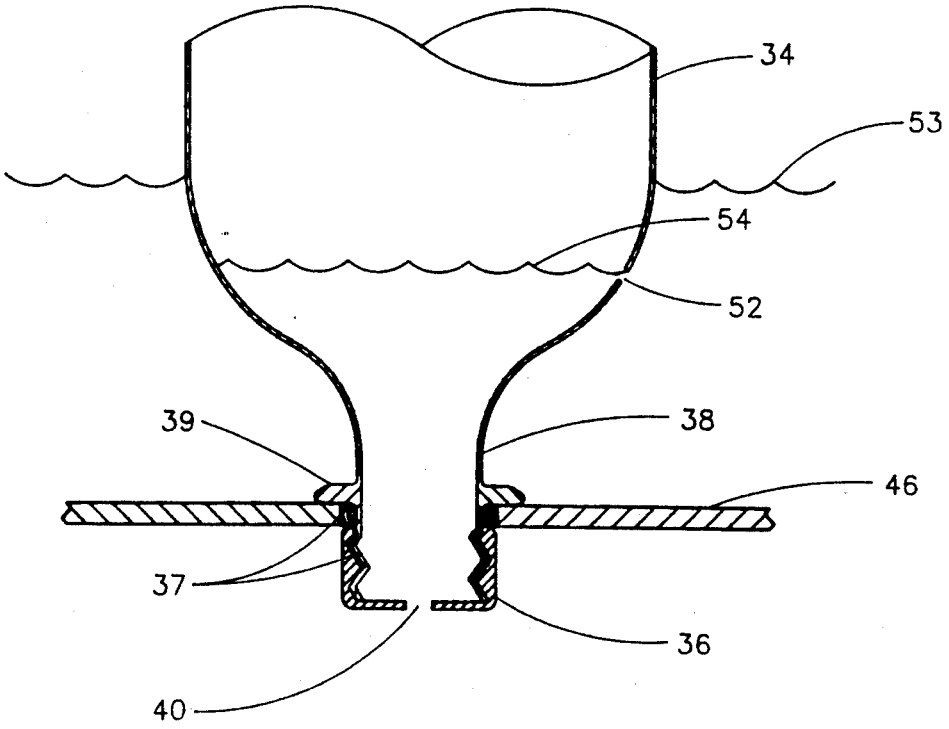
FIG. 8 is a partial elevational cross-section of a cell similar to the cells of FIG. 2 in which a limited opening in the cap and an additional opening in the side is shown to provide a ballasted structure.

A more limited opening is provided by screwing (and/or sealing) a cap 36 onto neck 38 and drilling a hole 40 through the end (see FIG. 8). A vent hole 52 is drilled at a selected distance above the cap 36 end in addition to hole 40. The smaller the holes, 40 and 52, the slower the ballast water 54 enters and leaves containers 34 giving a greater ballast effect for a longer time to counter any tipping caused by unbalanced "live" loads on the dock module 12. However, with small holes, 40 and 52, removal of the modules 12 from the water is more difficult because the modules are heavier for a longer time while the ballast water 54 drains from the cells. The ballast water 54 will enter the cell up to the level of vent hole 52 as seen in FIG. 8. The distance of the hole 52 above the cap 36 determines the amount of ballast water 54 and the freeboard of the dock above the water surface 53. We have found that a 6 mm diameter hole 40 and a 3 mm diameter hole 52 about 10 cm above the cap works well for two liter bottles.

By employing a combination of ballasted and non-ballasted cells using open, limitedly open, and closed cells, the stability of a floating platform can be regulated. For example, in the combination of FIG. 5, all of the peripheral cells are closed as indicated by "c" providing extra buoyancy around the edges to resist tilting. Open ended cells are indicated by "o". Changing the vent hole 52 distance above the cap 36 for different cells provides a graduated flotation. For example, by using different vent hole distances above the cap end in the open ended cells, the module 12 will gain flotation as the "live" load is increased and provide more constant freeboard as the "live" load changes. Also, using smaller holes 40 and 52 in the cells 30 near the edge of the module 12 gives a greater ballasting effect and resistance to tilting. Combinations of these basic structural forms not specifically discussed here will occur to those skilled in the art.

Not shown in the figures are attachments such as cleats for mooring boats alongside and lugs to connect anchor and spring lines to hold the assembled dock in place. These are well known to all those skilled in the art and are provided as required and may be varied for each particular installation.

We claim:

1. A docking system comprising at least one integral, unitary module disposable for floating upon the surface of a body of water comprising:

a hollow chamber comprising a substantially planar deck, said deck when said module is floating being generally parallel to said water surface, and having upper and lower sides relative to said water surface, said deck bounded by a periphery and abuttedly joined along the lower side of the periphery to the upper edge of a downwardly-depending wall, and an open bottom;

a flotation means disposed in the hollow chamber abutting the deck on the underside thereof and bonded thereto and comprising a honeycomb structure of joined cells orthogonal to the deck;

means for supporting substantially isotropic tension in the plane substantially bounded by the lower edge of the wall, the means joinedly connecting opposite lower edges of the wall and the cells.

2. The system of claim 1 wherein the cells of the honeycomb comprise plastic containers each having at least one closed end and a second end, the cells being in side-by-side, adhered-relationship filling the hollow chamber adjacent to the underside of the deck with the closed ends of the cells abutting the underside and adhered thereto.

3. The system of claim 2 wherein the second ends of the containers are closed by capping.

4. The system of claim 3 wherein the caps are adhered sealingly in place.

5. The system of claim 2 wherein the containers are selected from the group consisting of closed second end, limitedly-open second end, or fully open second end and the limitedly open ended and the fully open ended container have at least one vent hole in the container at a selected level between the ends to permit air to be vented as ballast water enters and leaves the open end and to determine the freeboard of the dock.

6. The system of claim 2 where the containers have a volumetric content from one pint to five gallons.

7. The system of claim 2 wherein the containers are recycled from used containers selected from the group comprising carbonated beverage bottles, still beverage bottles, milk bottles, bleach bottles and water bottles and paint containers.

8. The system of claim 1 wherein the deck and wall are fabricated from polymeric materials.

9. The system of claim 8 wherein the deck and/or wall are reinforced with continuous fibers.

10. The system of claim 1 wherein the means for supporting tension comprises:

a system of polymeric straps with at least one strap disposed in the hollow chamber joinedly spanning the wall substantially adjacent the lower edge thereof and running along a selected first axis joined to each cell of the honeycomb traversed by the first axis; and at least one strap disposed in the hollow chamber joinedly spanning the wall substantially adjacent the lower edge thereof and running along a second selected axis at a selected angle to the first axis and joined to each cell of the honeycomb traversed by the second axis.

11. The system of claim 10 wherein the straps are reinforced with axially disposed continuous filaments.

12. The system of claim 1 wherein the means for supporting tension is a substantially isotropic polymeric perforate sheet or net disposed in the hollow chamber joinedly spanning the wall substantially adjacent the lower edge thereof and joined to each cell of the honeycomb.

13. The system of claim 2 wherein the means for supporting tension is a substantially isotropic polymeric perforate sheet disposed in the hollow chamber joinedly spanning the wall adjacent the lower edge thereof and joined to each container by having the second end thereof capped after the second end is extended through a perforation in the sheet.

14. The system of claim 1 wherein at least one of the deck and wall is perforate.

15. The system of claim 1 wherein the downwardly depending wall comprises four walls of substantially equal depth joined to each other.

16. A docking system comprising a plurality of modules of claim 2 held one to the other by at least one elongate tensioned tie means extending the full combined length of the plurality of modules whereby stretch of the tie means occurs along the full length thereof.

17. The docking system of claim 16 further comprising alignment units of paired concave and convex mating structures fastenedly-disposed on abutting sides of the modules whereby relative vertical displacement of the modules is limited.

18. The docking system of claim 16 wherein the tie means is a cable freely disposed in a tubular encasement running through the hollow chamber.

19. The docking system of claim 18 wherein the tie means extends through alignment units fastenedly-disposed on the abutting sides of the modules.

20. The docking system of claim 19 wherein the alignment units are paired concave and convex mating structures fastenedly-disposed on abutting sides of the modules whereby relative vertical displacement of the modules is limited.

21. The docking system of claim 18 wherein a lubricant is disposed within the tubular encasement.

22. Flotation means for marine service comprising a planar honeycomb multi-cell structure disposable for flotation upon the surface of a body of water wherein the cells are plastic containers, each having a closed first end and a second end, and the cells are in closely packed array adhesively joined at the points of contact to form an integral unitary structure and the cells are orthogonal to the plane of the structure with the second ends extending downwardly from the surface of the body of water when the structure is disposed floatingly on the body of water.

23. The flotation means of claim 22 wherein the containers are recycled.

24. The flotation means of claim 22 wherein the containers are selected from the group consisting of closed second end, limitedly-open second end, or fully open second end and the limitedly-open ended and fully open ended containers have at least one vent hole in the container at a selected level between the ends whereby air is vented as ballast water enters and leaves and the freeboard is determined.

* * * * *